US006015122A

United States Patent [19]

Qui

[11] Patent Number: 6,015,122

[45] Date of Patent: Jan. 18, 2000

[54] FLAG HOLDER

[76] Inventor: Fei Qui, 3716 Barrington Bridge Pl., Richmond, Va. 23233

[21] Appl. No.: 09/079,811

[22] Filed: May 15, 1998

[51] Int. Cl.[7] ..... A45F 3/44

[52] U.S. Cl. ..... 248/156; 40/606

[58] Field of Search ..... 248/156, 121, 248/530, 153, 175, 302, 305, 218.4, 219.2; 211/16; 116/173; 40/604, 617; 223/88, 87, 85

[56] References Cited

U.S. PATENT DOCUMENTS

| | | | |
|---|---|---|---|
| D. 290,659 | 6/1987 | Patey | D26/138 |
| 695,663 | 3/1902 | Weirich | 116/173 |
| 1,408,636 | 3/1922 | Power | 40/613 |
| 1,512,130 | 10/1924 | Pardue | 211/16 |
| 2,499,538 | 3/1950 | Stanton | 223/88 |
| 2,559,302 | 7/1951 | Louft | 40/607 |
| 2,926,442 | 3/1960 | Reimel | 40/606 |
| 3,266,775 | 8/1966 | Coe | 254/127 |
| 3,348,745 | 10/1967 | Basile et al. | 223/88 |
| 3,995,796 | 12/1976 | Kline | 248/156 |
| 4,155,493 | 5/1979 | Palmaer | 223/85 |
| 4,343,449 | 8/1982 | Osthus | 248/156 |
| 4,474,316 | 10/1984 | Philibert | 223/88 |
| 5,161,720 | 11/1992 | Kolton et al. | 223/85 |
| 5,388,709 | 2/1995 | Adams | 211/70.6 |
| 5,473,839 | 12/1995 | Stidham | 47/47 |
| 5,694,733 | 12/1997 | Gallemore, II | 52/736.2 |

*Primary Examiner*—Ramon O. Ramirez
*Assistant Examiner*—Anita M. King

[57] ABSTRACT

A flag support including a vertical base, a horizontal rod having a support end proximate the vertical base and an outer end, extending from the base, a flag support rod parallel to, below and separated from the horizontal rod, and having a support end, proximate the base, and an outer end, extending from the base. The outer end of the flag support rod includes a generally unshaped bend which forms a tortuous path between the outer ends of both rods to prevent accidental removal of the flag from the flag support rod. In the normal configuration, the outer ends of the horizontal rod and the flag support rod are contiguous and face each other, however, at least the flag support rod is sufficiently flexible from the vertical base as to provide a path for insertion of a hemmed flag onto the flag support rod between the horizontal rod and the flag support rod when the flag support rod is displaced from parallel relationship with the horizontal support rod.

10 Claims, 3 Drawing Sheets

FLAG HOLDER

FIELD OF THE INVENTION

The present invention relates to an improved suspension system for ornamental flags. More specifically, it relates to an ornamental flag suspension device which allows easy installation and removal of an ornamental flag while providing an attractive and functional mounting system which inhibits accidental flag removal.

BACKGROUND OF THE INVENTION

The display of so-called "lawn flags" which depict flowers, birds, animals, greetings, etc. has become very popular in recent years. A large variety of systems have been suggested and marketed for mounting such flags and installing them either in the ground or attached to a vertical surface such as a lamp post. Such a mounting device or support which allows for easy installation and removal of a flag while providing a secure, "windproof", and at the same time, attractive support for a flag is of significant commercial interest and value in the home landscaping market.

Accordingly, it is an object of the present invention to provide a flag suspension device which permits easy installation and removal of a flag, while providing a secure and attractive display medium for such flags.

Other objects of the invention will become apparent to the skilled artisan when the attached description is read in conjunction with the appended claims.

SUMMARY OF THE INVENTION

According to the present invention there is provided a flag support including a vertical base, a horizontal rod having a support end proximate the vertical base and an outer end, extending from said base, a flag support rod, extending sideways from the base, parallel to, below and separated from the horizontal rod, and having a support end proximate the base, and an outer end. The outer end of the flag support rod includes a bend which forms a tortuous path between the outer ends of both rods to prevent accidental removal of the flag from the flag support rod. According to a preferred embodiment, in the normal configuration, the outer ends of the horizontal rod and the flag support rod face each other, however, the flag support rod is sufficiently flexible from the vertical base as to provide a path for insertion of a hemmed flag onto the flag support rod between the flag support rod and the horizontal rod when the flag support rod is displaced from parallel relationship with the horizontal support rod.

DETAILED DESCRIPTION OF THE INVENTION

Figure 1:
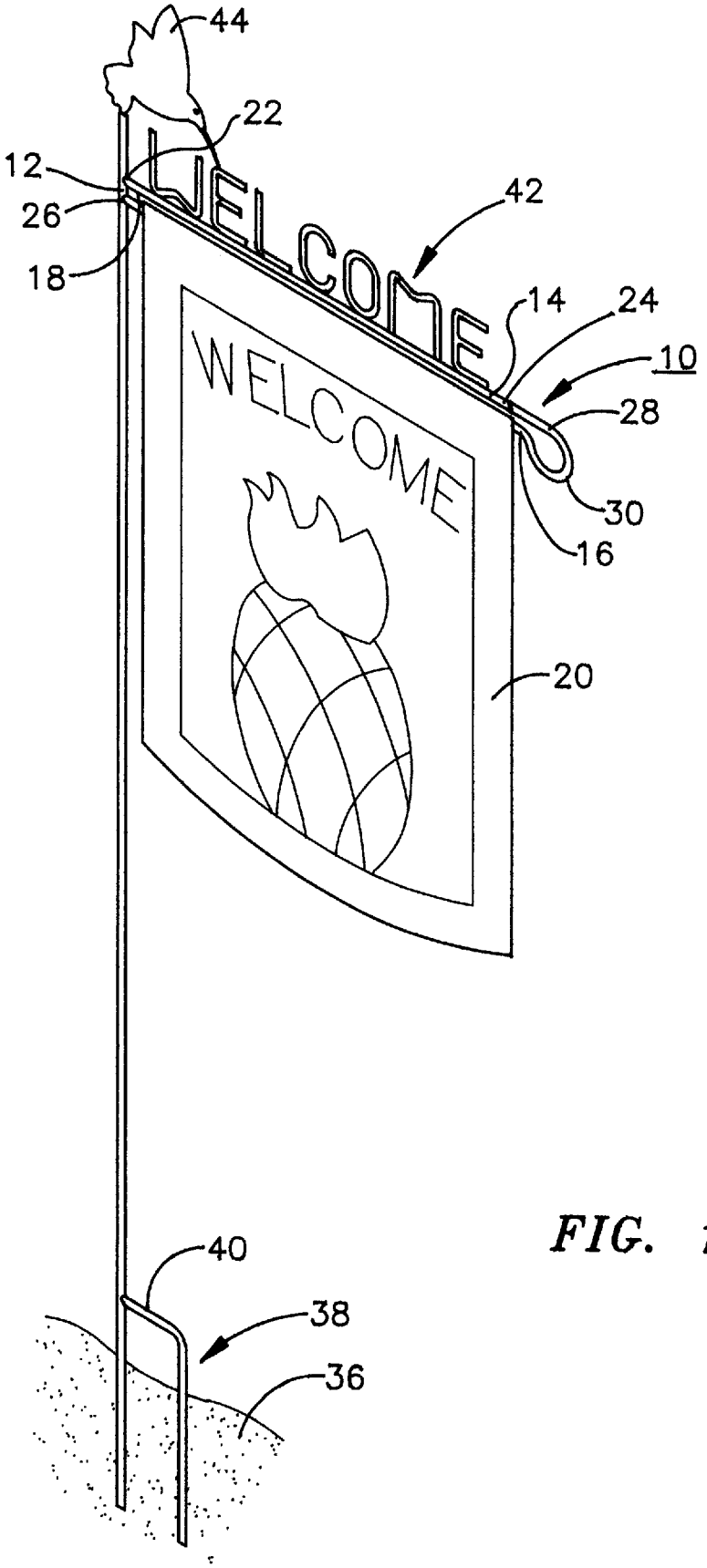
FIG. 1 is a perspective view of one embodiment of the flag support of the present invention with a flag installed.

As shown in FIG. 1, the flag support 10 of the present invention includes a vertical base 12, in this case a vertical post or rod, a horizontal rod 14 extending sideways, and in most instances at right angles, from the vertical base. Flag support rod 16 also extends sideways from vertical base 12 parallel to and below horizontal rod 14 and separated from horizontal rod 14 by gap 18 which is of sufficient width as to permit insertion of flag 20 onto flag support rod 16 as will be described hereinafter. Horizontal rod 14 has a support end 22 and an outer end 24. Flag support rod 16 has a support end 26 and an outer end 28.

Figure 4:
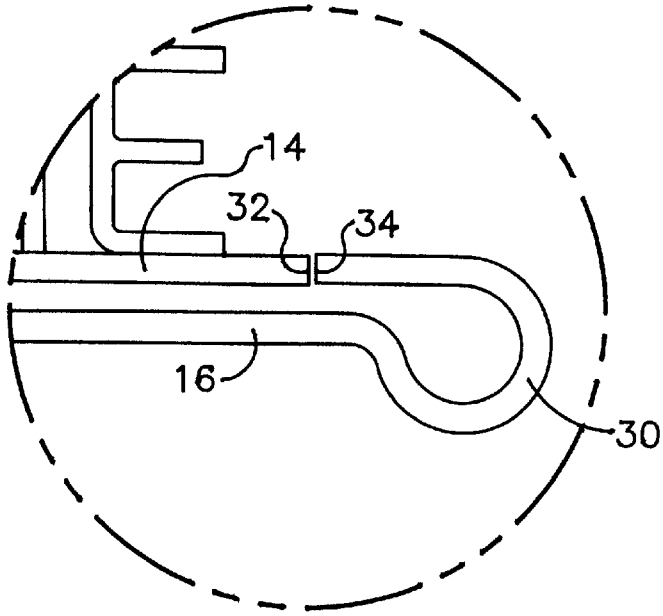
FIG. 4 shows a detailed view of the outer ends of the horizontal and flag support rods.
Figure 5:
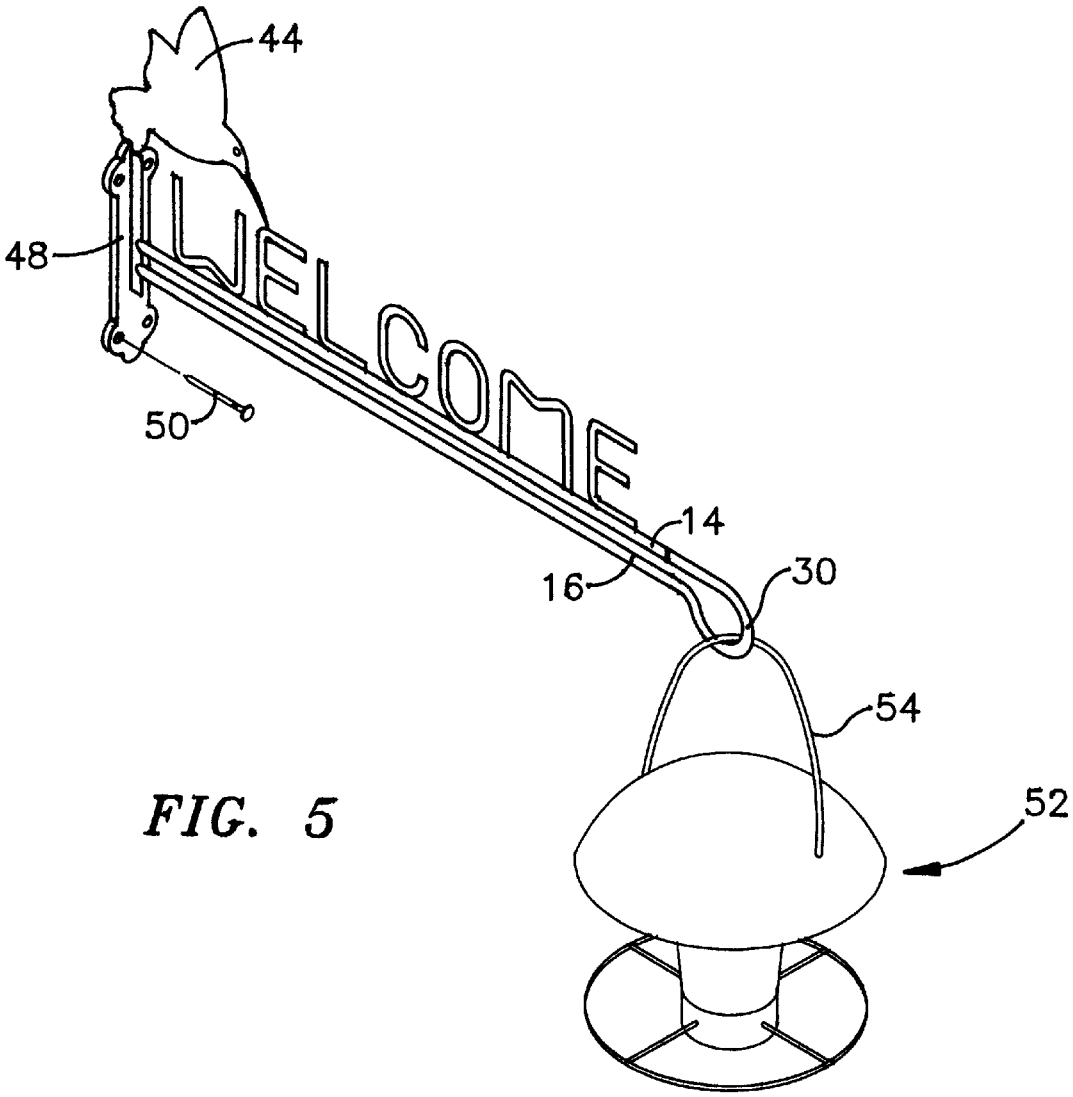
FIG. 5 is a perspective view of a second embodiment of the flag support of the present invention having an adjunct device or accessory, in this case a bird feeder, mounted thereon.

Outer end 28 of flag support rod 16 is preferably crimped or bent to form bend 30 which provides a tortuous entrance between horizontal rod 14 and flag support rod 16. According to a preferred embodiment, bend 30 is generally unshaped such that the very ends 32 and 34, shown more clearly in FIG. 3, of horizontal rod 14 and flag support rod 16 respectively face each other in general registration to provide the appearance of a single continuous rod from a distance. Although bend 30 is described as being "generally u-shaped", it is to be understood that bend 30 may, and preferably does, incorporate some asymmetry as shown most clearly in FIG. 4. Such incorporation of asymmetry provides a means for retaining the attachment portion of any subsequently attached accessory, as shown in FIG. 5 and described hereinafter.

In the embodiment depicted in FIG. 1, vertical base 12 comprises a vertical rod or post suitable for insertion into ground 36. To assist with such insertion, in this embodiment, a rectangular open-sided loop or ell 38 forms part of vertical base 12 such that insertion into the ground is accomplished by simply stepping on the top 40 of ell 38. According to a preferred embodiment of the present invention, horizontal rod 14, flag support rod 16, vertical base 12 and ell 38 are all formed from cast iron. More preferably, these components are formed from 8 mil cast iron. According to a highly preferred embodiment, vertical base 12, as depicted in FIG. 1 is about 40 inches long, flag support rod 16 is made from 6 mil cast iron, horizontal rod 14 is made from 8 mil cast iron, the length of flag support rod 16 from vertical base 12 to the end of generally u-shaped bend 30 is about 15 inches and open rectangular loop 38 is about 2 ¼ inches wide and 6 inches high. Of course the skilled artisan will realize that any suitable plastic or metallic material of adequate and appropriate dimensions which is sufficiently rigid as to provide the required support while being sufficiently flexible as to permit installation of flag 20 as described hereinafter may also be substituted. Such materials include rigid plastics such as PVC and polyethylene as well as aluminum and mild steel. In the case where the flag support is fabricated from cast iron, horizontal rod 14 and flag support rod 16 are welded to vertical base 12.

As also shown in FIG. 1, signage or ornamental lettering 42 may be applied as an integral part of or attached to horizontal rod 14. Similarly, a logo or ornamental feature such as the hummingbird design 44 shown in FIG. 1, may be suitably attached. The attachment of such an ornamental feature serves to further improve the rigidity of horizontal rod 14.

Figure 2:
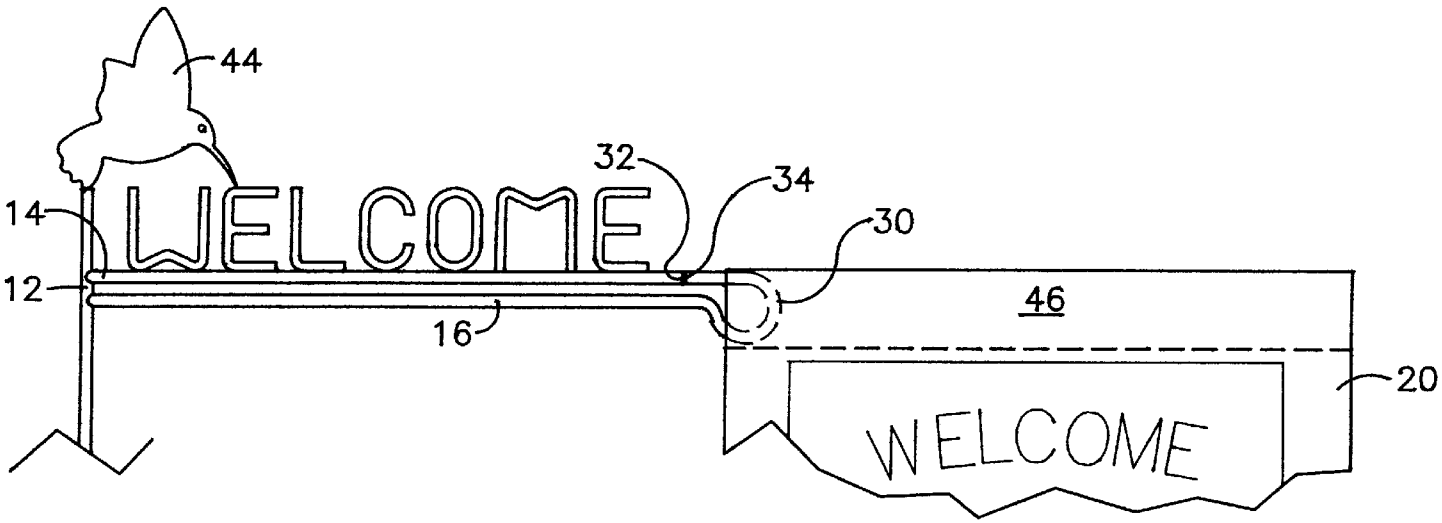
FIG. 2 is a perspective view of the flag support of the present invention showing the start of installation of a flag thereon.
Figure 3:
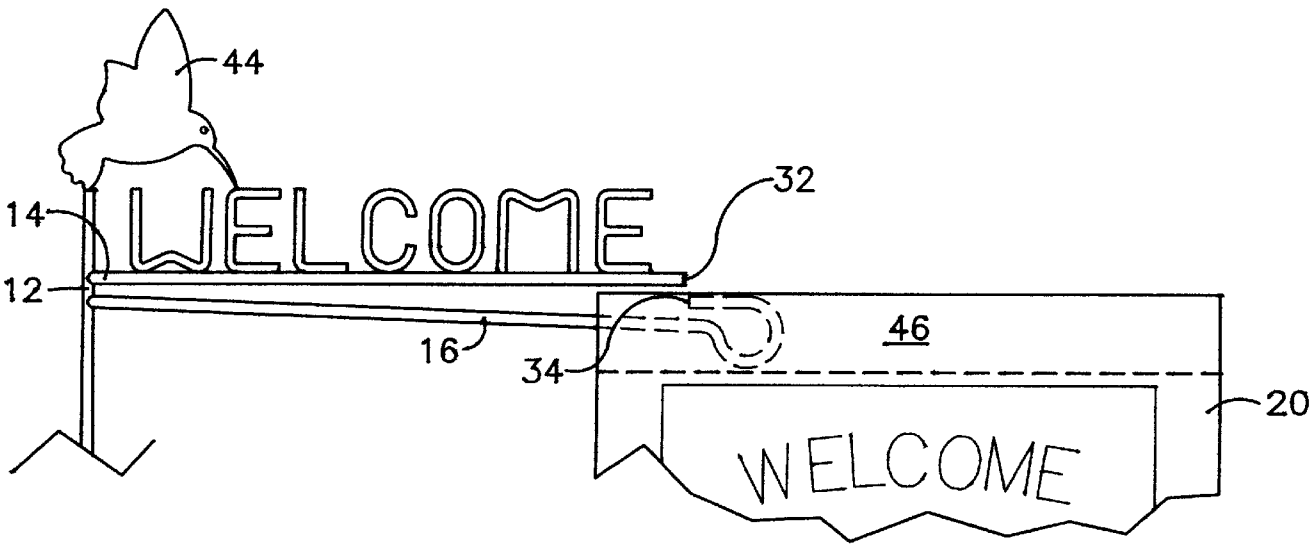
FIG. 3 is a perspective view of the flag support of the present invention showing a flag partially installed thereon.

As demonstrated in FIGS. 2 and 3, installation of a flag 20 on flag support rod 16 is accomplished by insertion of bend 30 of flag support rod 16 into the hemmed portion 46 of flag 20. Flag support rod 16 is then flexed as, shown in FIG. 3, such that hemmed portion 46 may pass between horizontal rod 14 and flag support rod 16. Upon complete insertion of hemmed portion 46 over flag support rod 16, flag 20 depends from flag support rod 16 and horizontal rod 14 and flag support rod 16 return to their original configuration shown in detail in FIG. 4, with ends 32 and 34 in proximate registration facing each other so as to provide the appearance of a single continuous rod member from a distance.

Alternatively, if hem portion 46 of flag 20 is too narrow to insert over bend 30, the hemmed portion may be threaded over the tortuous path defined at the outer end of flag support rod 16 while displaced from parallel relationship with horizontal rod 14.

Whichever method is used to install flag 20, once flag 20 is installed on flag support rod 16, it is impossible to accidentally remove flag 20 from flag support 16 since absent dislocation of the hemmed portion 46 of flag 20 such that it can pass over bend 30 and, in the preferred embodiment, any relative displacement of ends 32 and 34 from one another, there is no path by which the flag can be accidentally removed.

FIG. 5 shows an alternative embodiment of the flag support of the present invention. In this embodiment, vertical support 12 is comprised of a bracket 48 which is mounted to any suitable surface with any suitable fastener such as a nail 50, a screw or a bolt. Also as shown in FIG. 5, bend 30 of flag support rod 16 may be used to support some accessory such as the bird feeder 52 shown here either with or without the presence of a flag. Application of such an accessory device is accomplished in the same fashion as installation of flag 20, i.e. by displacement of flag support rod 16 from parallel relationship with horizontal rod 14 and insertion of the bail 54 or other attachment device of the accessory over the asymmetric bend 30.

While preferred embodiments have been described and shown, it will be understood that it is not intended to limit the disclosure, but rather it is intended to cover all modifications and alternate embodiments falling within the spirit and scope of the invention as defined in the appended claims.

What is claimed is:

1. A flag holder including a vertical base, a horizontal rod extending sideways from the vertical base and having a support end proximate the vertical base and an outer end, a flag support rod extending sideways from the base parallel to, below and separated from the horizontal rod and having a support end proximate the base and an outer end, the flag support rod or the horizontal rod including a bend which defines a tortuous path between the outer ends of the horizontal rod and the flag support rod to prevent a flag from being accidentally removed from the flag support rod, and including a space between said outer ends of said horizontal rod and said flag support rod to permit the insertion of a flag.

2. The flag holder of claim 1 wherein said bend is generally unshaped such that the outer ends of said horizontal rod and said flag support rod face each other.

3. The flag holder of claim 2 wherein said bend is asymmetric so as to provide a means for suspending an accessory therefrom.

4. The flag holder of claim 1 wherein said base comprises a vertical rod suitable for insertion into the ground.

5. The flag holder of claim 4 wherein said vertical rod includes an ell at its base to permit easier ground insertion.

6. The flag holder of claim 5 wherein said vertical base is about 40 inches long, said flag support rod is about 15 inches long, and said ell is about 2 ¼ inches by 6 inches.

7. The flag holder of claim 1 wherein said vertical base, said horizontal rod and said flag support rod are all 8 mils in diameter.

8. The flag holder of claim 1 fabricated from cast iron wherein said horizontal rod and said flag support rod are welded to said vertical base.

9. The flag holder of claim 1 wherein said vertical base is a bracket having mounting holes therein suitable for receiving fastening devices for attaching said flag holder to a vertical support.

10. The flag holder of claim 1 further including signage or ornamental lettering on top of said horizontal support rod.

* * * * *